US005625331A

United States Patent [19]

Yamada et al.

[11] Patent Number: 5,625,331

[45] Date of Patent: Apr. 29, 1997

[54] SUPERCONDUCTING DEFLECTION ELECTROMAGNET APPARATUS

[75] Inventors: Tadatoshi Yamada, Amagasaki; Takeo Kawaguchi, Kobe; Tetuya Matuda, Amagasaki; Toshie Takeuchi, Amagasaki; Ituo Kodera, Amagasaki; Shunji Yamamoto, Amagasaki; Shirou Nakamura, Amagasaki, all of Japan

[73] Assignee: Mitsubishi Denki Kabushiki Kaisha, Tokyo, Japan

[21] Appl. No.: 139,305

[22] Filed: Oct. 19, 1993

[30] Foreign Application Priority Data

Oct. 21, 1992 [JP] Japan ..... 4-283187

[51] Int. Cl.[6] ..... H01F 1/00

[52] U.S. Cl. ..... 335/216; 335/300; 335/210; 62/51.1; 505/211

[58] Field of Search ..... 335/300, 301, 335/210, 213, 216; 62/51.1, 51.3; 505/211, 879, 892, 893, 894, 898

[56] References Cited

U.S. PATENT DOCUMENTS

| | | | |
|---|---|---|---|
| 4,599,592 | 7/1986 | Marsing | 335/216 |
| 4,737,727 | 4/1988 | Yamada et al. | 328/227 |
| 4,783,628 | 11/1988 | Huson | 324/320 |
| 4,783,634 | 11/1988 | Yamamoto et al. | 328/235 |
| 5,117,212 | 5/1992 | Yamamoto | 335/210 |

FOREIGN PATENT DOCUMENTS

| | | |
|---|---|---|
| 0156017 | 10/1985 | European Pat. Off. . |
| 3530446 | 3/1986 | Germany . |
| 3704442A1 | 8/1987 | Germany . |
| 3928037A1 | 3/1990 | Germany . |
| 4000666A1 | 7/1990 | Germany . |
| 2165988 | 4/1986 | United Kingdom . |
| 2223350 | 4/1990 | United Kingdom . |

OTHER PUBLICATIONS

Physik in unserer zeit, /16. Jahrg. 1985/Nr. 5.

Nuclear Instruments and Methods in Physics Research pp. 105–113.

Abstract zur JP 4–71 199.

Abstract zur JP 3–30 298.

*Primary Examiner*—Lincoln Donovan
*Attorney, Agent, or Firm*—Wolf, Greenfield & Sacks, P.C.

[57] ABSTRACT

A superconducting deflection electromagnet apparatus for deflecting an electron beam includes a liquid helium reservoir 21 disposed outside of the magnetic shield 11 surrounding the cryostat 4 accommodating the upper and lower liquid helium containers 2 in which coil assemblies 1, 31, 32 are disposed. Preferably, the upper and lower liquid helium containers 2 are supported from the cryostat 4 by means of the thermally insulating support members 5, 6 and 8 whose positions are adjustable by means of the threaded projections 5*a*, 6*a* and 8*a* and the nuts 52, 53, 62, 63, 82, 83 engaging therewith. The nuts secure the respective thermally insulating support members to the cap-shaped fixing members 44, 47, 49 attached to the extensions 43, 45, 49 of the cryostat 4.

7 Claims, 14 Drawing Sheets

SUPERCONDUCTING DEFLECTION ELECTROMAGNET APPARATUS

BACKGROUND OF THE INVENTION

This invention relates to superconducting electromagnet apparatus, especially those for deflecting charged particle beams such as electrons, which are provided with a magnetic shield for confining the leakage fields.

FIG. 18 is a plan view of a conventional superconducting deflection electromagnet apparatus, which is disclosed, for example, in Japanese Laid-Open Patent (Kokai) No. 2-174099. FIG. 19 is a sectional view of the superconducting deflection electromagnet apparatus along the line A—A in FIG. 18, as viewed in the direction of the arrows. FIG. 20 is a perspective view of the superconducting deflection electromagnet apparatus of FIG. 18. Within a magnetic shield 11 is disposed a cryostat 4, in which is accommodated the deflection coil assembly: main coils 1, quadrupole correction coils 31, and sextupole correction coils 32. When excited, the coils 1, 31, and 32 generate a magnetic field as represented by the magnetic field line 12. The beam duct (not shown), inserted into the cavity 70, extends between the upper and the lower coil assemblies.

The method of operation of the superconducting deflection electromagnet apparatus is as follows. The superconducting coils 1, 31, and 32 are excited to produce a magnetic field represented by the magnetic field line 12. The charged particle beam proceeding through the beam duct between the upper and the lower coil assemblies is deflected 180 degrees by the Z-component (see the coordinate axes shown in the figures) of the magnetic field. The magnetic field line 12 extending out of the cryostat 4 is confined substantially within the magnetic shield 11. The magnetic shield 11 thus shields in the magnetic field leaking out of the cryostat 4. Since the magnetic field line 12 extends through the magnetic shield 11, an electromagnetic force acts between the coils and the magnetic shield 11.

The above conventional superconducting deflection electromagnet apparatus, however, has the following disadvantage. The reservoir (not shown) for the liquid helium is disposed within the cryostat 4. Thus, when a large quantity of the liquid helium is to be held in the reservoir, the size of the cryostat 4 and hence that of magnetic shield 11 surrounding it become greater. Further the magnetic shield 11 is a heavy construct of a large volume, so that its construction and assembly is difficult.

Furthermore, in the case of the above superconducting deflection electromagnet apparatus, errors in the relative position between the coils and the magnetic shield 11 may result from the production inaccuracy, the thermal shrinkage of the parts produced at the normal temperature and then cooled to a very low temperature, and the deformation of the support structure due to the electromagnetic force acting among the coils. Since the relative position between the coils and the magnetic shield 11 is not adjustable, the errors in the relative positions cause deviations from the design values in the electromagnetic forces acting between the coils and the magnetic shield 11. Usually, the relative position between the coils and the magnetic shield 11 is designed to minimize the electromagnetic force acting therebetween. Thus, when the relative position is deviated from the design value due to an error, the electromagnetic force acting between the coils and the magnetic shield 11 may become too large for the support structure.

SUMMARY OF THE INVENTION

It is therefore an object of this invention to provide a superconducting deflection electromagnet apparatus by which: a reservoir for holding a large amount of the coolant liquid can be provided without increasing the volume of the magnetic shield; the production and assembly of the magnetic shield is simplified; and the electromagnetic force acting between the superconducting coils and the magnetic shield can be minimized.

The above object is accomplished in accordance with the principle of this invention by a superconducting electromagnet apparatus which comprises a superconducting coil assembly; a cryostat accommodating the superconducting coil assembly; a magnetic shield surrounding the cryostat; and a coolant medium reservoir disposed outside of the magnetic shield and communicating with an interior portion of the cryostat.

Alternatively, the superconducting electromagnet apparatus according to this invention includes: a superconducting coil assembly having a plane of symmetry; a cryostat accommodating the superconducting coil assembly; and a magnetic shield surrounding the cryostat, the magnetic shield including a top plate, a bottom plate, and a side wall, wherein the top plate and bottom plate are formed symmetric with respect to the plane of symmetry of the superconducting coil assembly.

Still alternatively, the superconducting electromagnet apparatus may include: a superconducting coil assembly; a cryostat accommodating the superconducting coil assembly; and a magnetic shield surrounding the cryostat, the magnetic shield including a top plate, a bottom plate, and a side wall, wherein at least a portion of the the side wall is disposed directly between the top plate and bottom plate.

Further, the superconducting electromagnet apparatus may include: a superconducting coil assembly; a cryostat accommodating the superconducting coil assembly; and a magnetic shield surrounding the cryostat, wherein at least a portion of the magnetic shield has a laminated structure made of layers of thick plates of a predetermined thickness.

Furthermore, the superconducting electromagnet apparatus may include: a superconducting coil assembly; a cryostat accommodating the superconducting coil assembly; thermally insulating support members supporting the superconducting coil assembly within the cryostat; a magnetic shield surrounding the cryostat; and adjustment mechanism means, disposed on the thermally insulating support members, the adjustment mechanism means adjusting positions of the thermally insulating support members to translate the superconducting coil assembly relative to cryostat, wherein the adjustment mechanism can be operated from outside of the magnetic shield.

Still further, the superconducting electromagnet apparatus may include: a superconducting coil assembly; a cryostat accommodating the superconducting coil assembly; a magnetic shield surrounding the cryostat; and adjustment mechanism means, disposed upon the magnetic shield or cryostat, the adjustment mechanism means adjusting a position of the cryostat relative to the magnetic shield, wherein the adjustment mechanism can be operated from outside of the magnetic shield.

Further still, the superconducting electromagnet apparatus may include: a superconducting coil assembly; a cryostat accommodating the superconducting coil assembly; a magnetic shield surrounding the cryostat; adjustment mechanism means for adjusting a position of the superconducting coil assembly relative to the cryostat or the magnetic shield, wherein the adjustment mechanism can be operated from outside of the magnetic shield; and measurement means, such as scaled rods, for measuring the relative position of the superconducting coil assembly from outside of the magnetic shield.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
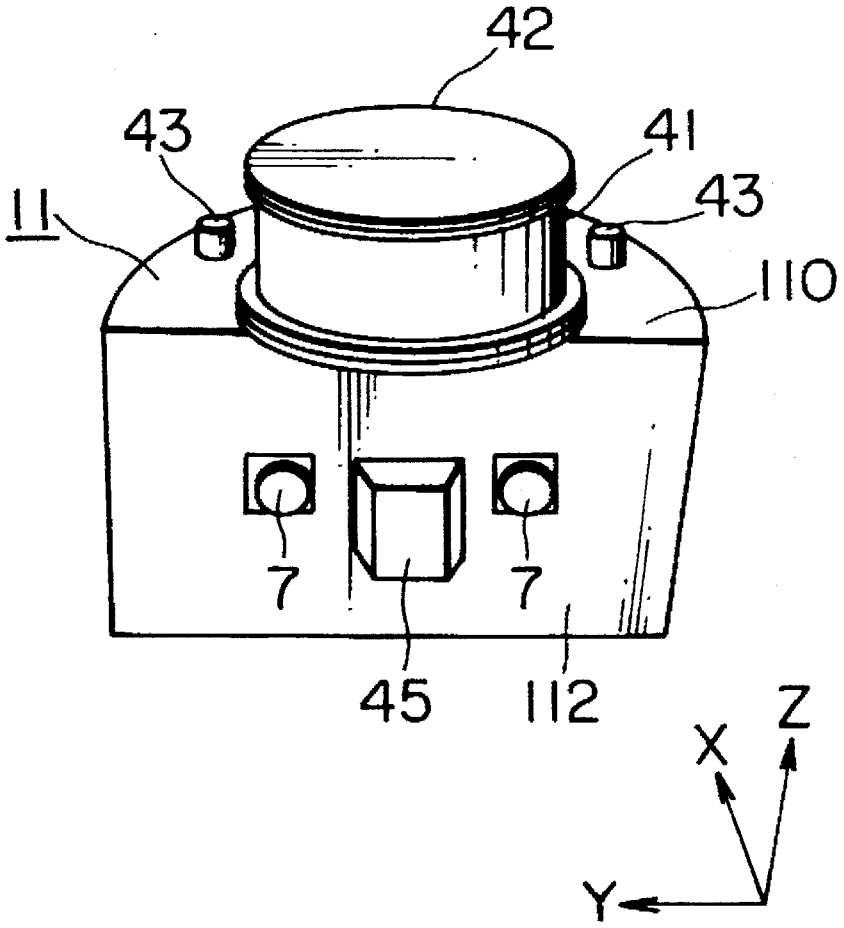
FIG. 1 is a perspective view of a superconducting deflection electromagnet apparatus according to an embodiment of this invention.
Figure 2:
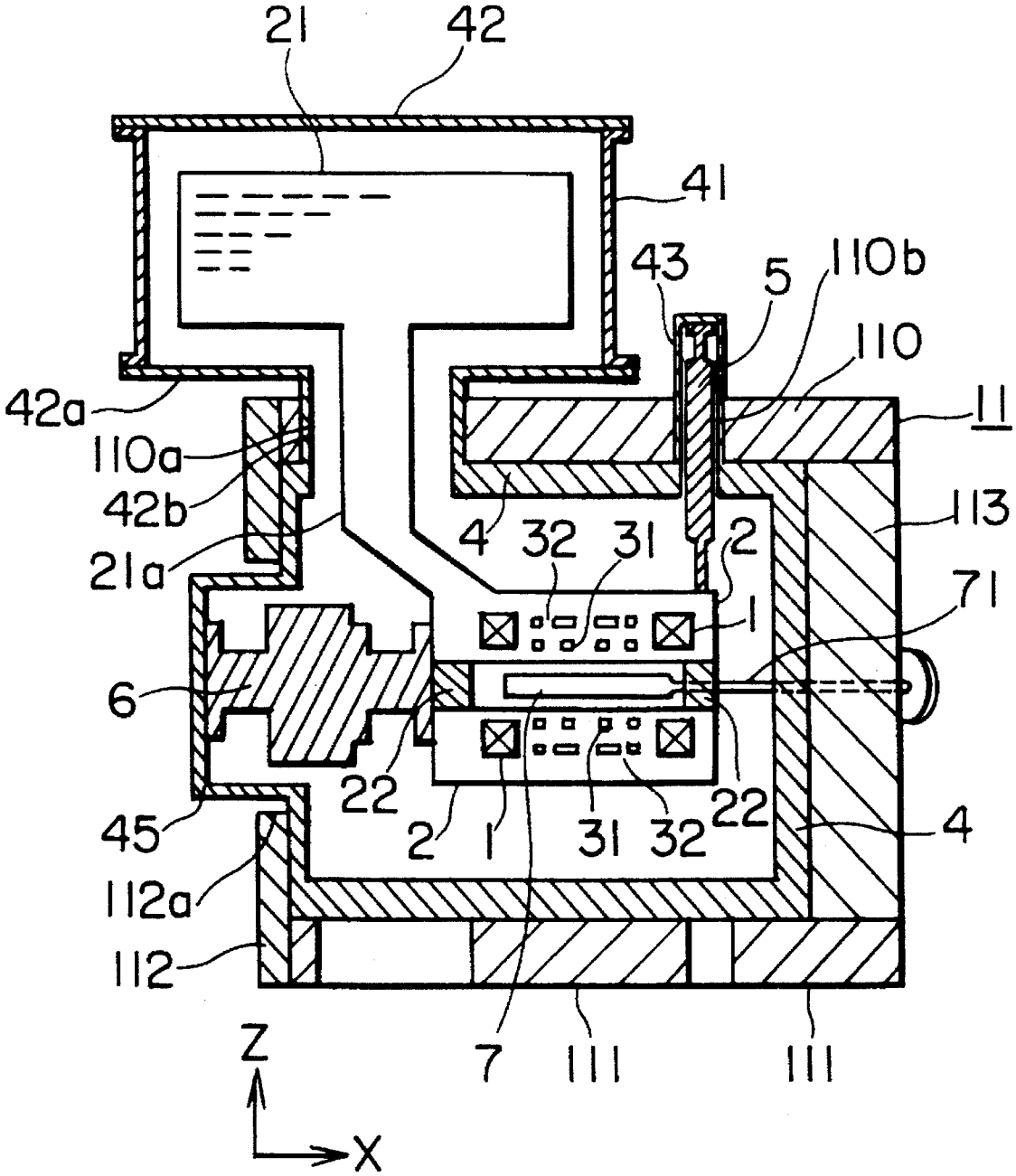
FIG. 2 is a sectional view of the superconducting deflection electromagnet apparatus of FIG. 1 along a mid plane perpendicular to the Y-axis.
Figure 18:
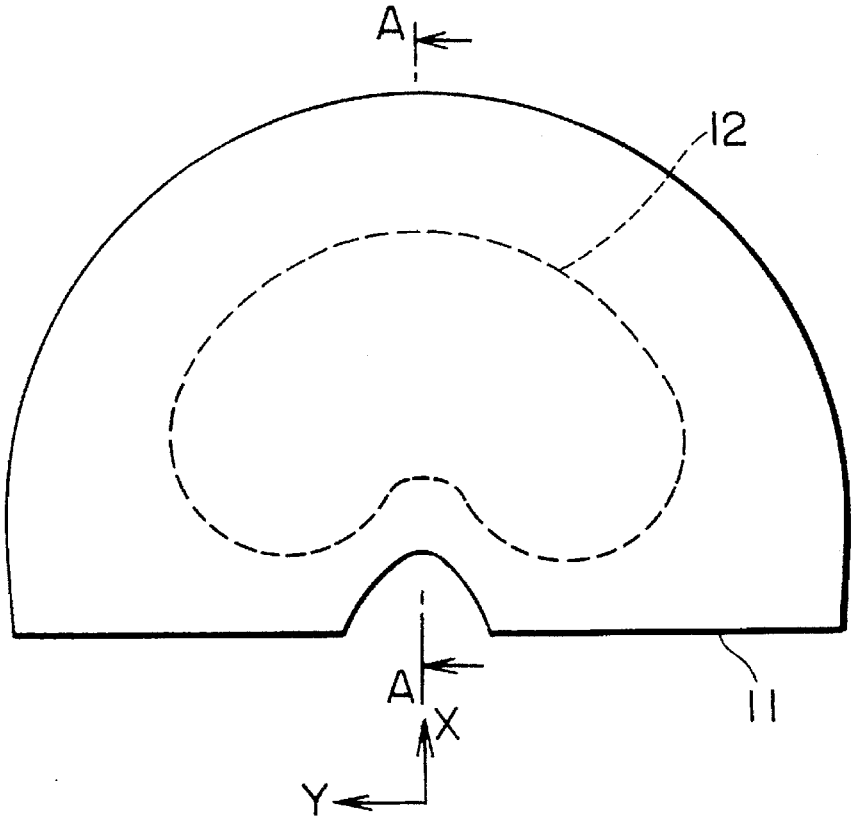
FIG. 18 is a plan view of a conventional superconducting deflection electromagnet apparatus.
Figure 19:
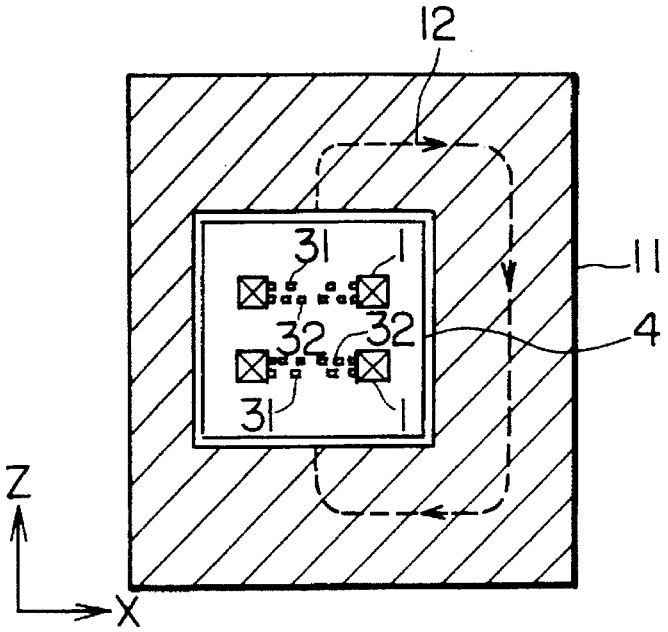
FIG. 19 is a sectional view of the superconducting deflection electromagnet apparatus along the line A—A in FIG. 18, as viewed in the direction of the arrows.
Figure 20:
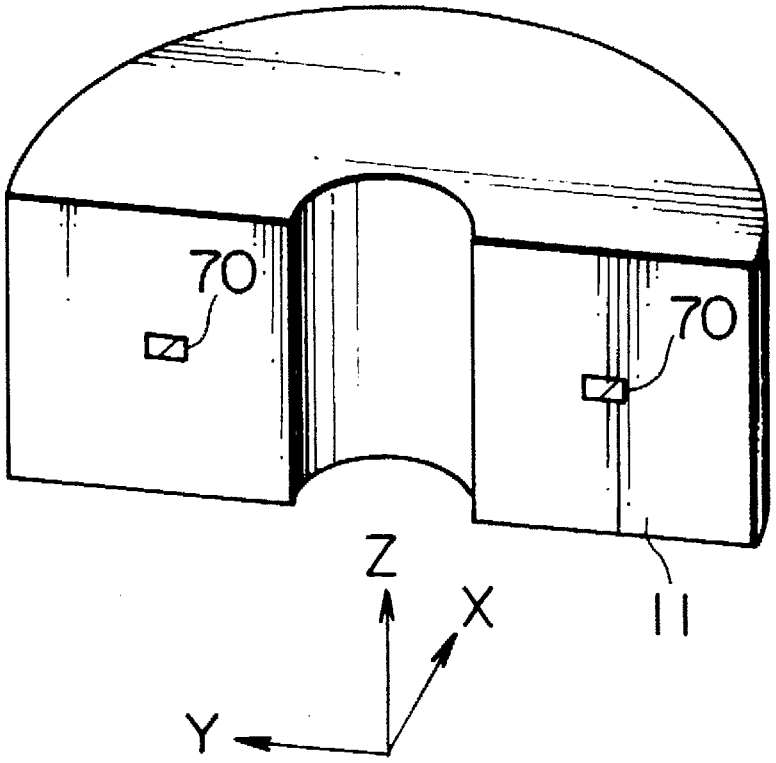
FIG. 20 is a perspective view of the superconducting deflection electromagnet apparatus of FIG. 18.

FIG. 1 is a perspective view of a superconducting deflection electromagnet apparatus according to an embodiment of this invention. FIG. 2 is a sectional view of the superconducting deflection electromagnet apparatus of FIG. 1 along a mid plane perpendicular to the Y-axis. The parts corresponding to those of FIGS. 18 through 20 are designated by the same reference numerals, such that the repetition of the descriptions may be avoided.

A hollow semi-cylindrical magnetic shield 11, consisting of a semi-disk shaped top plate 110 and bottom plate 111, a plane side wall 112, and a semi-cylindrical side wall 113, houses therewithin a cryostat 4 of substantially the same form. Disposed within the cryostat 4 are semi-circular ring-shaped upper and lower liquid helium containers 2 accommodating the upper and the lower group, respectively, of the main coils 1, the quadrupole correction coils 31, and the sextupole correction coils 32. The low temperature electromagnetic force supports 22 are inserted between the upper and lower liquid helium containers 2 to bear the electromagnetic force acting between the upper and the lower group of the coils. A cylindrical liquid helium reservoir 21 communicating with the upper and lower liquid helium containers 2 via a vertical liquid helium duct 21*a* and extending out of the magnetic shield 11 through a main through-hole 110*a* in the top plate 110 of the magnetic shield 11 is housed within a cylindrical vacuum container formed by a top plate 42, a side wall 41, and a bottom plate 42*a*, which vacuum container is coupled to the cryostat 4 via an extension 42*b* surrounding the liquid helium duct 21*a* and extending through the main through-hole 110*a* of the top plate 110 of the magnetic shield 11. Since the liquid helium reservoir 21 is disposed outside of the magnetic shield 11, the size and the weight of the cryostat 4 and the magnetic shield 11 can be minimized.

A plurality of hollow cylindrical vertical extensions 43 projecting upward (in the direction of Z-axis) from the top plate of the cryostat 4 extend through peripheral through-holes 110*b* formed in the top plate 110 in registry therewith. Thermally insulating support members 5, anchored at the top ends thereof to the respective vertical extensions 43 of the cryostat 4, suspends the upper and lower liquid helium containers 2 from the vertical extensions 43 of the cryostat 4. Further, a hollow cylindrical horizontal extension 45 projecting horizontally (in the negative direction of the X axis) from the front side of the cryostat 4 extend through a through-hole 112*a* formed in the plane side wall 112 of the magnetic shield 11. A thermally insulating support member 6, fixed at one end thereof to the bottom of the cylindrical horizontal extension 45, supports the upper and lower liquid helium containers 2 in cooperation with the thermally insulating support members 5. A plurality of radiation chambers 71, coupled to the beam duct chamber 7 disposed between the upper and lower coil assemblies lead the X-ray to lithography ports at the outside of the semi-cylindrical side wall 113 of the magnetic shield 11.

Figure 3:
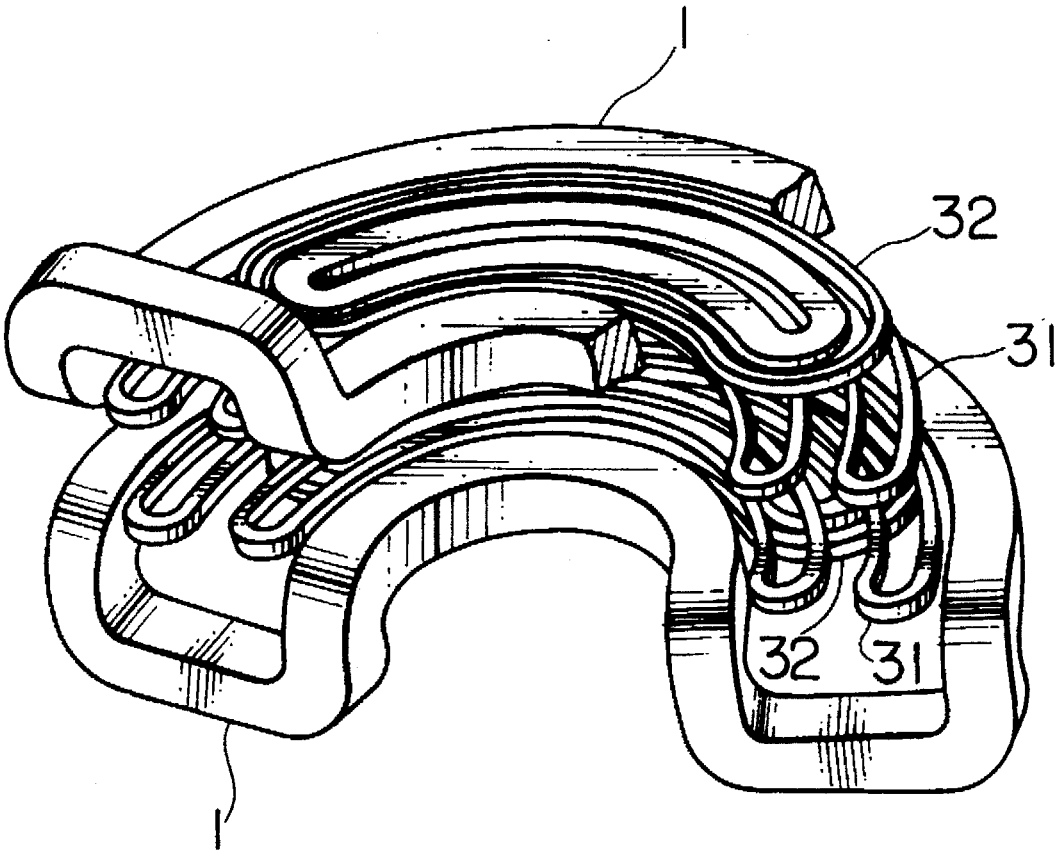
FIG. 3 is a perspective view of the coil assemblies (with a part of the upper main coil removed) accommodated within the upper and lower liquid helium containers 2 of FIG. 2.
Figure 4A:
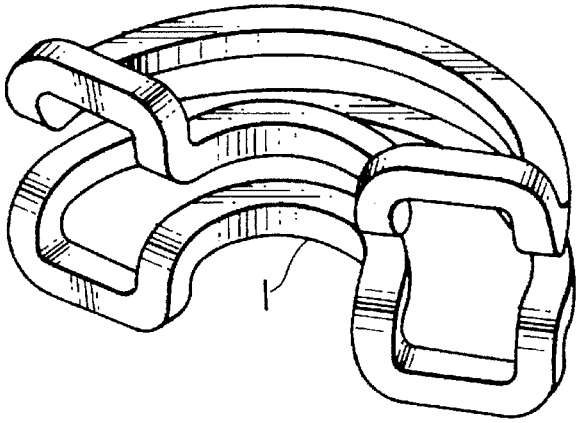
FIG. 4*a* is a perspective view of the main coils 1 of FIG.
Figure 4B:
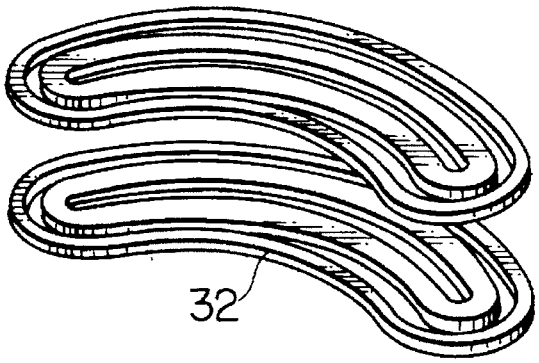
FIG. 4*b* is a perspective view of the sextupole correction coils 32 of FIG. 3.
Figure 4C:
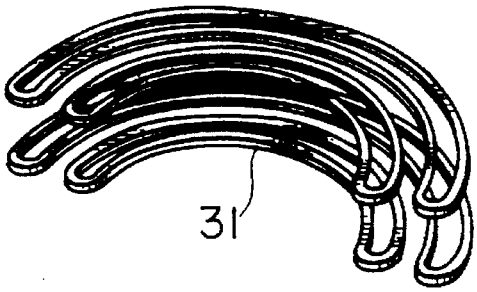
FIG. 4*c* is a perspective view of the quadrupole correction coils 31 of FIG. 3.

FIG. 3 is a perspective view of the coil assemblies (with a part of the upper main coil removed) accommodated within the upper and lower liquid helium containers 2 of FIG. 2, and FIGS. 4*a*, 4*b*, and 4*c* show the main coils 1, the sextupole correction coils 32, and the quadrupole correction coils 31, respectively. The dipole magnetic field generated by the upper and lower race-tracked shaped main coils 1 accommodated within the upper and lower liquid helium containers 2 is corrected by the quadrupole correction coils 31 and the sextupole correction coils 32, such that the charged particle beam is correctly deflected along the semi-circular path within the beam duct.

Figure 5:
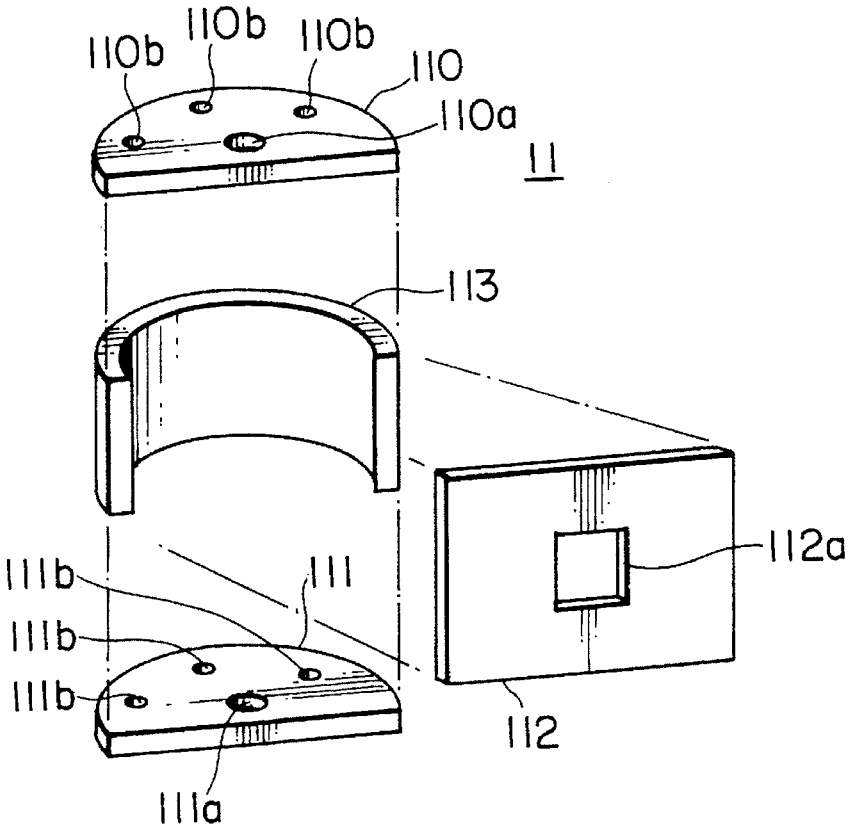
FIG. 5 is an exploded perspective view of the magnetic shield 11 of FIGS. 1 and 2.

FIG. 5 is an exploded perspective view of the magnetic shield 11 of FIGS. 1 and 2. In the case of this embodiment, the bottom plate 111 has an identical form as the top plate 110. Thus the bottom plate 111 has a main through-hole 111*a* and peripheral through-holes 111*b* formed therethrough, in registry with the main through-hole 110*a* and the peripheral through-holes 110*b* of the top plate 110. The top plate 110 and the bottom plate 111 having identical forms are disposed symmetrically with respect to the horizontal mid plane between the upper and lower coil assemblies. Thus, the electromagnetic force acting in the vertical direction (along the Z-axis) between the coils and the magnetic shield 11, as accumulated (i.e., summed up) for all the coils, substantially vanishes.

Figure 6:
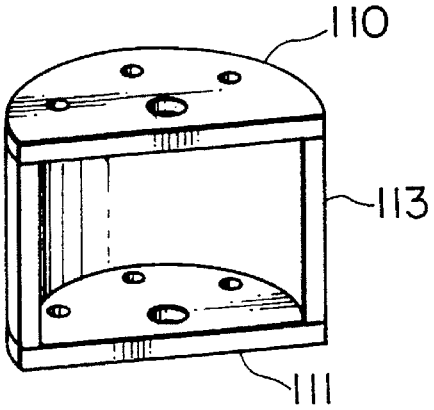
FIG. 6 is a perspective view of the magnetic shield 11 of FIGS. 1 and 2 in a partially assembled form.

FIG. 6 is a perspective view of the magnetic shield 11 of FIGS. 1 and 2 in a partially assembled form. As shown in FIG. 6, the top plate 110 and the bottom plate 111 are first positioned on the upper and lower end surfaces of the semi-cylindrical side wall 113. Then, the plane side wall 112, having a height equal to the height of the semi-cylindrical side wall 113 plus the thicknesses of the top plate 110 and the bottom plate 111, is attached to the front end surface of the three parts 110, 111, and 113. The partial assembled state of the parts 110, 111, and 113 as shown FIG. 6 is relatively stable, and the assembly of the magnetic shield 11 is facilitated.

Figure 7:
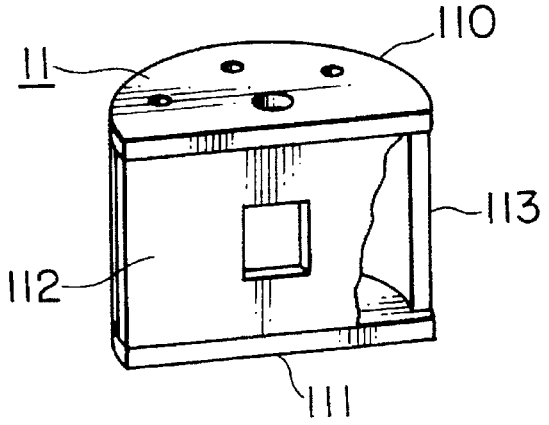
FIG. 7 is a perspective view of a modified structure of the magnetic shield 11.

FIG. 7 is a perspective view of a modified structure of the magnetic shield 11. The plane side wall 112 having the same height as the semi-cylindrical side wall 113 is attached to the front end surface of the semi-cylindrical side wall 113, and the top plate 110 and the bottom plate 111 are placed on the top and bottom of the plane side wall 112 and the semi-cylindrical side wall 113. This structure of the magnetic shield 11 also has the advantage that the assembly thereof is easy.

Figure 8:
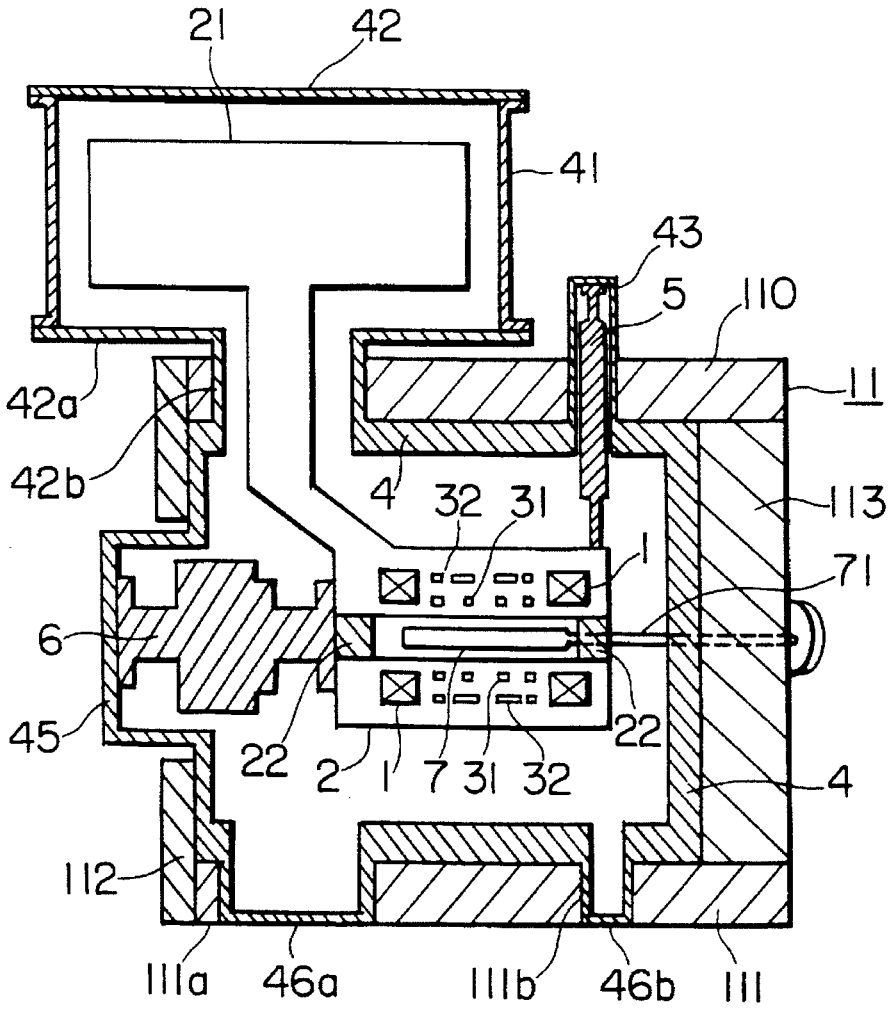
FIG. 8 is a view similar to that of FIG. 2, but showing the structure of another superconducting deflection electromagnet apparatus according to this invention.

FIG. 8 is a view similar to that of FIG. 2, but showing the structure of another superconducting deflection electromagnet apparatus according to this invention. The superconducting deflection electromagnet apparatus of FIG. 8 is similar to that of FIGS. 1 and 2. However, the cryostat 4 has bottom projections 46*a* and 46*b* extending into the main through-hole 111*a* and the peripheral through-holes 111*b*, respectively. This form of the cryostat 4 further reduces the accumulative electromagnetic force acting upon the coils. Namely, the top plate 42, the side wall 41 and the bottom plate 42*a* forming the vacuum container and the vertical extensions 43 of the cryostat 4 extend above the top plate 110 of the magnetic shield 11. In the case where the cryostat 4, etc., are formed of a ferromagnetic material, these upper projections disturb the symmetry of the arrangement of the magnetic material. The projections 46*a* and 46*b* formed on the bottom of the cryostat 4 are inserted into the holes 111*a* and 111*b*, respectively, to improve the symmetry of the arrangement the magnetic materials (the cryostat 4, the magnetic shield 11, etc.) With respect to the coil assembly. The accumulative electromagnetic force acting upon the coils is thereby reduced. Thus the radius of the thermally insulating support members 5 can be reduced and the efficiency of thermal insulation can be improved.

Figure 9:
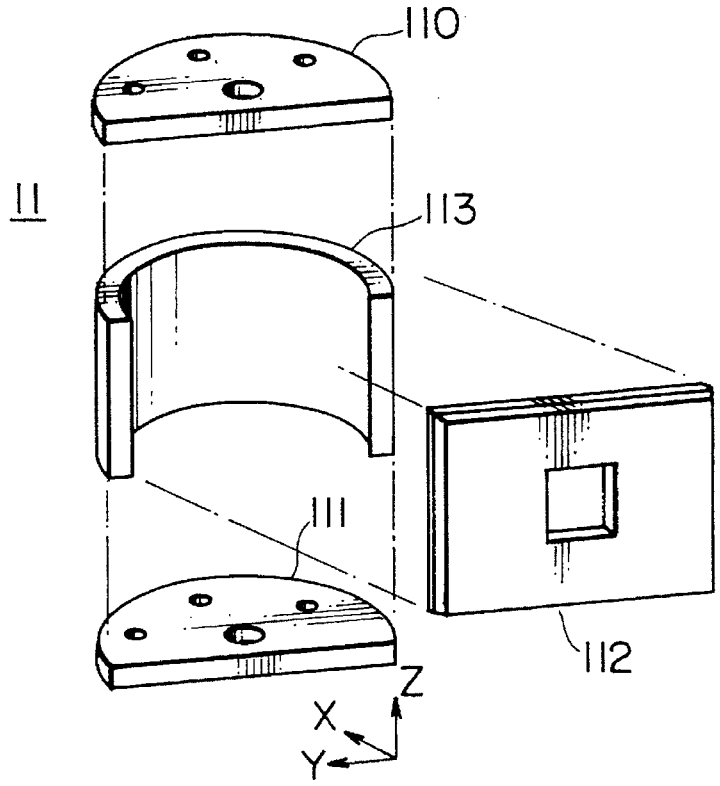
FIG. 9 shows an exploded perspective view of another modified structure of the magnetic shield 11.
Figure 10:
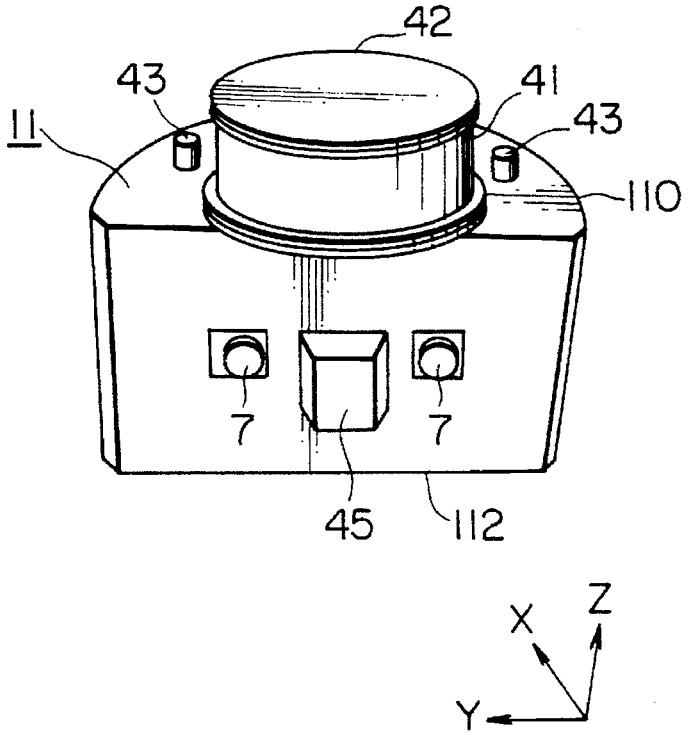
FIG. 10 is a perspective view of a superconducting deflection electromagnet apparatus housed in the magnetic shield of FIG. 9.

FIG. 9 shows an exploded perspective view of another modified structure of the magnetic shield 11. FIG. 10 is a perspective view of a superconducting deflection electromagnet apparatus housed in the magnetic shield of FIG. 9. As shown in the figures, the outer edge of the lateral end surfaces (the surfaces perpendicular to the Y-axis) of the plane side wall 112 of the magnetic shield 11 is beveled. As described above in the introductory portion of this specification, the coils produce a magnetic field directed along the Z-axis. The leakage field going out of the cryostat 4 extends into but confined within the the magnetic shield 11. The lateral end surfaces of the plane side wall 112 of the magnetic shield 11 are situated farthest away from the coils and the leakage field therefrom is negligible. Thus, without adverse effects on the leakage of the magnetic field, the edges of these lateral end surfaces of the plane side wall 112 can be beveled and the weight of the magnetic shield 11 can thereby be reduced.

Figure 11:
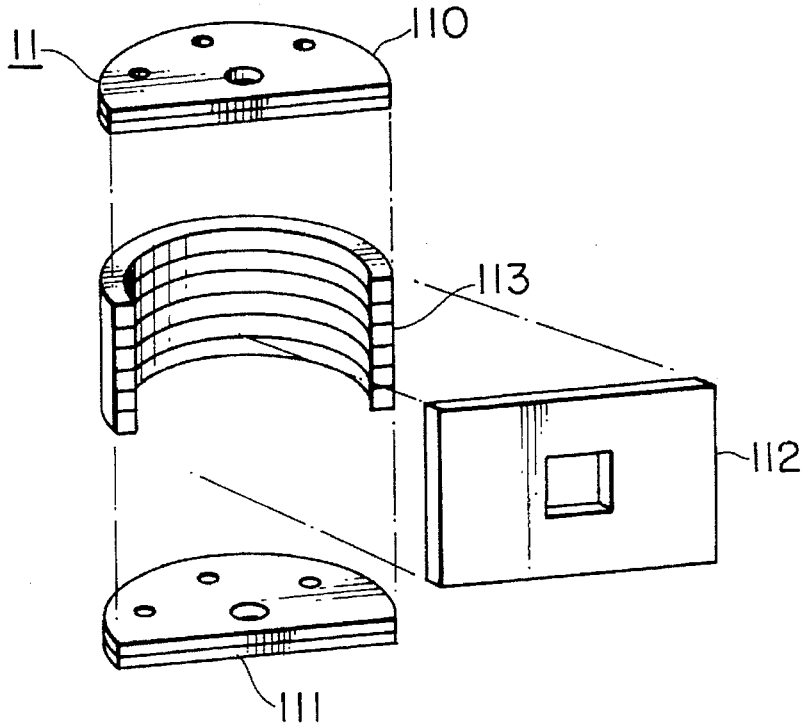
FIG. 11 shows an exploded perspective view of still another modified structure of the magnetic shield 11.

FIG. 11 shows an exploded perspective view of still another modified structure of the magnetic shield 11. The top plate 110, the bottom plate 111 and the semi-cylindrical side wall 113 of the magnetic shield 11 exhibit a horizontally laminated structure. Namely, the top plate 110, the bottom plate 11 and the semi-cylindrical side wall 113 are formed of horizontal layers of thick iron plates, each having a predetermined standard thickness. The plane side wall 112, on the other hand, has a solid single plate structure (i.e., the non-laminated structure).

The lamination of the top plate 110, the bottom plate 11 and the semi-cylindrical side wall 113 of the magnetic shield 11 facilitates the production and assembly thereof. Further, since the respective parts 110, 111, and 113 can be cut out of an iron plate of standard dimensions while minimizing the waste portions, the cost of the material can be reduced. On the other hand, the solid plane side wall 112 exhibit a greater rigidity than the laminated parts. Thus, the inward directed electromagnetic force from the coils produce only a small deformation in the plane side wall 112 attached to the top plate 110, the bottom plate 111 and the semi-cylindrical side wall 113. Thus, the force on the cryostat 4 resulting from the deformation of the plane side wall 112 is minimized and is held within an allowance, However, in the case where a gap can be maintained between the cryostat 4 and the plane side wall 112 such that some deformation of the plane side wall 112 is allowed, the plane side wall 112 may also be made of a laminated plate as other parts 110, 111, and 113.

Figure 12:
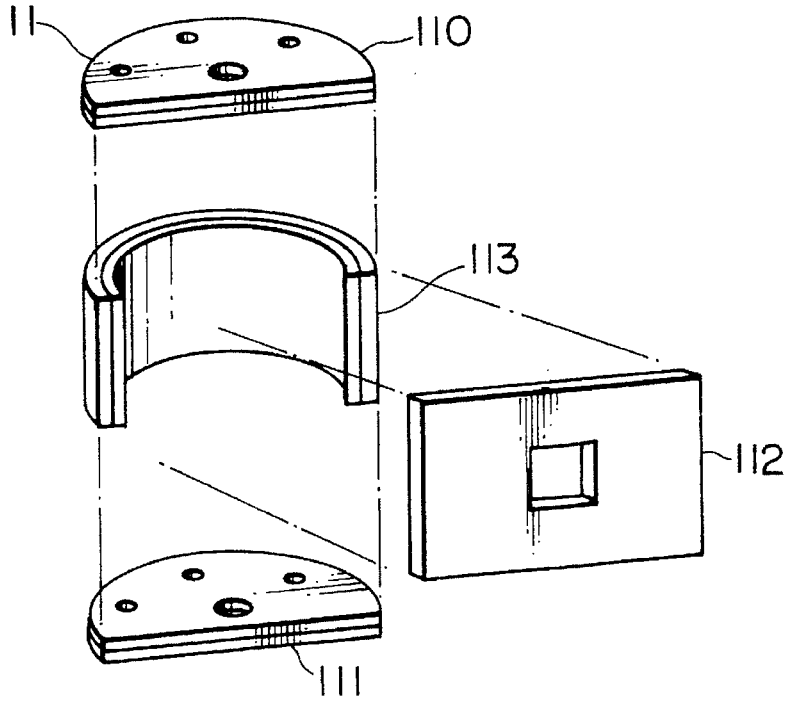
FIG. 12 shows an exploded perspective view of still another modified structure of the magnetic shield 11.

FIG. 12 shows an exploded perspective view of still another modified structure of the magnetic shield 11. In this case, the semi-cylindrical side wall 113 is laminated in the direction of the thickness thereof (i.e., consists of layers extending in the circumferential direction of the semi-cylindrical side wall 113). The same advantages as those of the laminated structure shown in FIG. 11 can be obtained.

Figure 13:
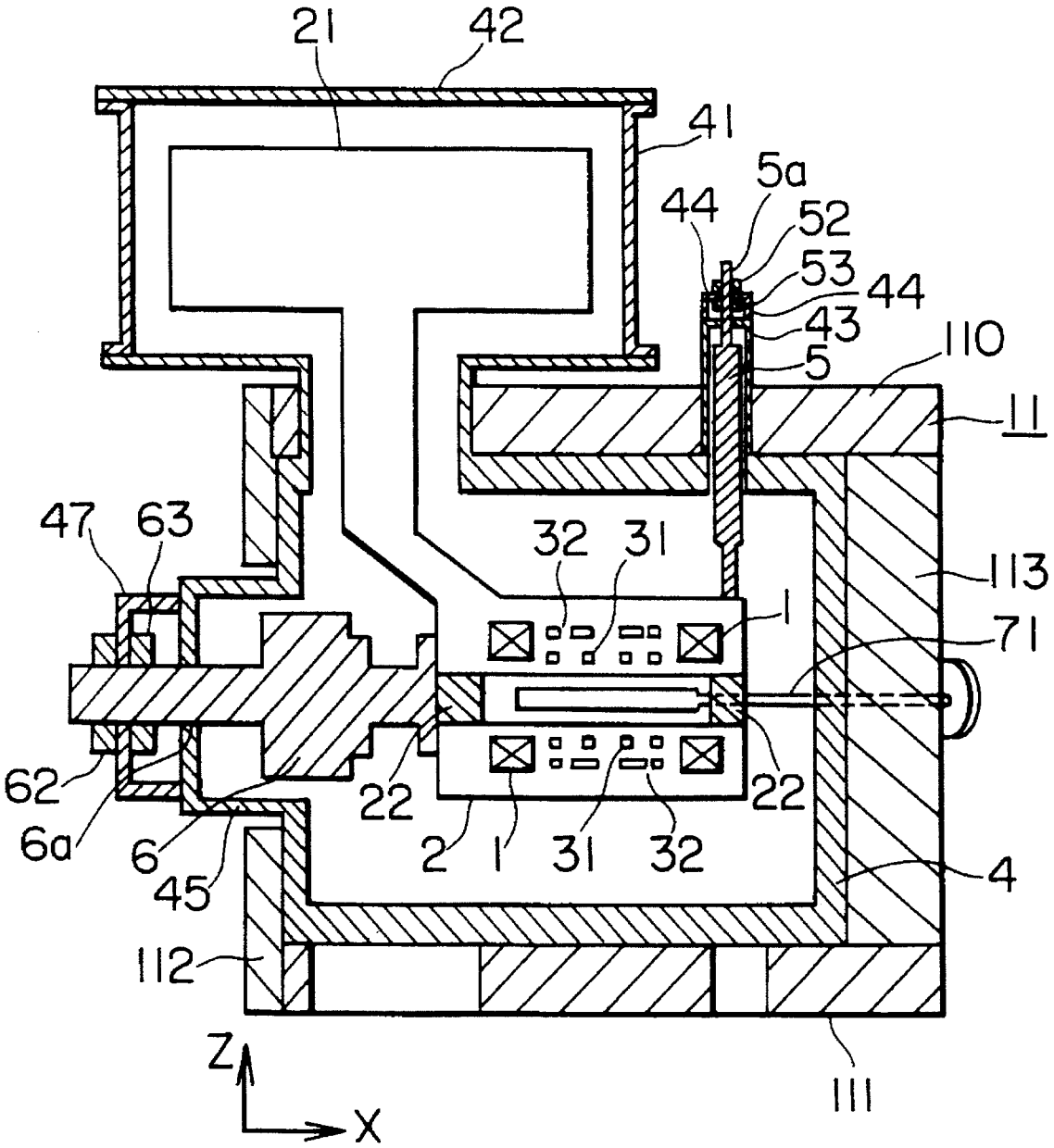
FIG. 13 is a view similar to that of FIG. 2, but showing the structure of still another superconducting deflection electromagnet apparatus according to this invention.

FIG. 13 is a view similar to that of FIG. 2, but showing the structure of still another superconducting deflection electromagnet apparatus according to this invention. The superconducting deflection electromagnet apparatus is similar to that of FIG. 2. However, each of the thermally insulating support members 5 has a threaded projection 5*a* which extends through a through-hole formed in the top of the vertical extensions 43 of the cryostat 4 and a through-hole formed in a cap-shaped fixing member 44 attached to the top of the vertical extensions 43. Each of the thermally insulating support members 5 is secured to the fixing member 44 by means of an outer nut 52 and an inner nut 53 engaging with the threaded projection 5*a* of the member 5. The fixing member 44 and the nuts 52 and 53 hermetically seal the end portion of the thermally insulating support members 5.

Similarly, the thermally insulating support member 6 has a threaded projection 6*a* which extends through a through-hole formed in the bottom (i.e., the left end in the figure) of the horizontal extension 45 of the cryostat 4 and a through-hole formed in a cap-shaped fixing member 47 attached to the bottom of the horizontal extension 45. The thermally insulating support member 6 is fixedly secured to the fixing member 47 by means of an outer nut 62 and an inner nut 63 engaging with the threaded projection 6*a* of the thermally insulating support member 6. The fixing member 47 and the nuts 62 and 63 hermetically seal the end portion of the thermally insulating support member 6.

Figure 14:
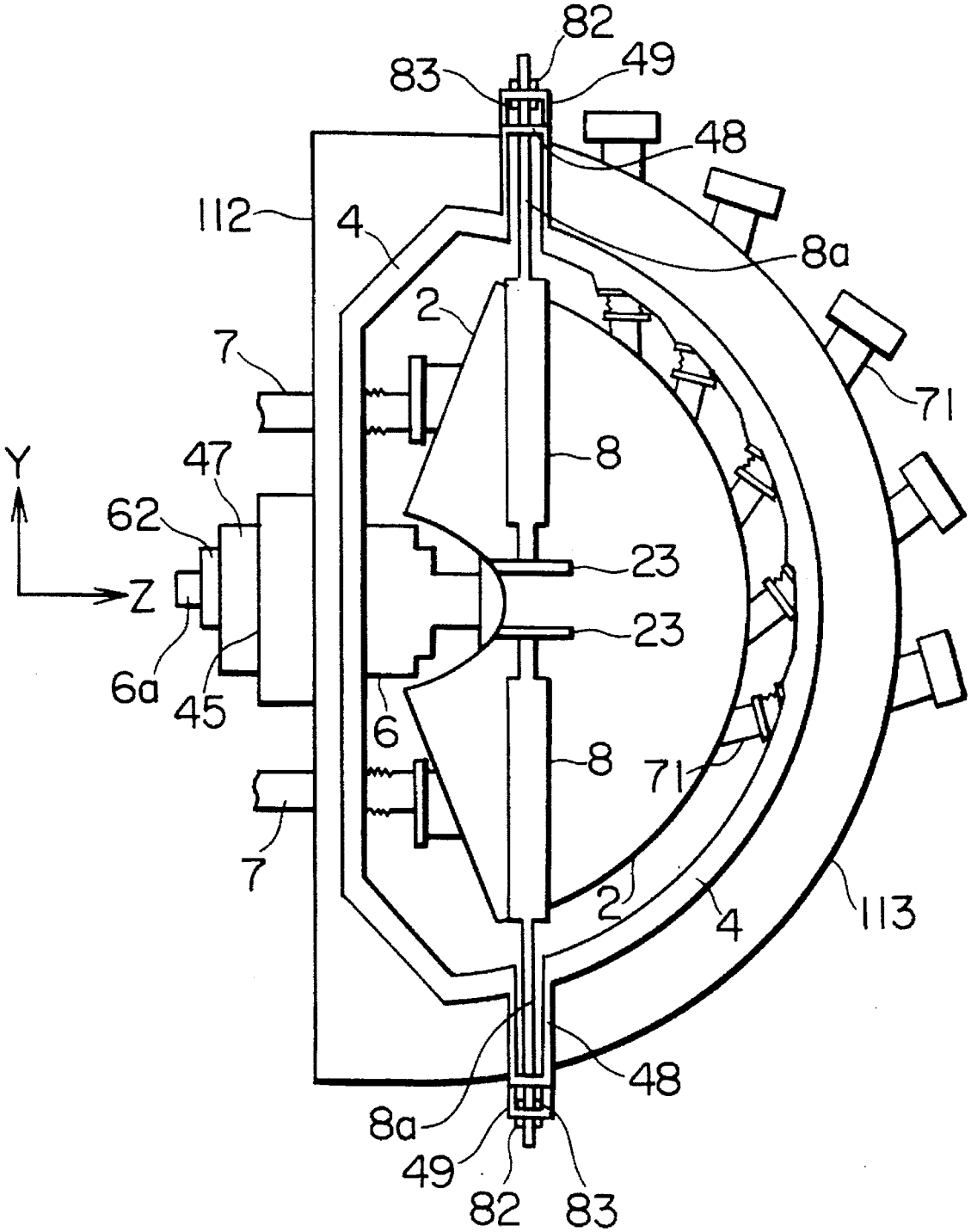
FIG. 14 is a schematic plan view of the superconducting deflection electromagnet apparatus of FIG. 13 with the top plates of the magnetic shield 11 and the cryostat 4 removed, showing the interior of the apparatus.

FIG. 14 is a schematic plan view of the superconducting deflection electromagnet apparatus of FIG. 13 with the top plates of the magnetic shield 11 and the cryostat 4 removed, showing the interior of the apparatus. A pair of thermally insulating support members 8 are secured at the inner ends hereof to fixing members 23, respectively, attached to the liquid helium containers 2. Further, the cryostat 4 has a pair of horizontal extensions 48 extending in the positive and negative directions of the Y-axis. Each of the thermally insulating support members 8 has a threaded projection 8*a* at the outer end thereof. The projection 8*a* extends through a through-hole formed in the outer end of the horizontal extensions 48 of the cryostat 4 and a through-hole formed in a cap-shaped fixing member 49 attached to the end of the horizontal extensions 48. The thermally insulating support members 8 are secured to the fixing member 49 by means of an outer nut 82 and an inner nut 83 engaging with the threaded projection 8*a* of the thermally insulating support members 8. The fixing member 49 and the nuts 82 and 83 hermetically seal the end portion of the thermally insulating support members 8.

The structure of the superconducting deflection electromagnet apparatus of FIGS. 13 and 14 allows the adjustment of the relative position of the coils and the cryostat 4 from outside of the magnetic shield 11. For example, assume that the coil assemblies are to be moved in the positive direction of the X-axis relative to the cryostat 4. Then, the outer nut 62 is first rotated to be translated toward left in the figure (the negative direction of the X-axis). Next, the inner nut 63 is rotated likewise to be translated toward left relative to the thermally insulating support member 6, thereby translating the thermally insulating support member 6 toward right (relative to the absolute position of the cryostat 4 and the magnetic shield 11). The thermally insulating support member 6 thus pushes the upper and lower liquid helium containers 2 toward right, and the coils contained in the upper and lower liquid helium containers 2 are translated toward right (the positive direction of the X-axis) relative to the cryostat 4 and the magnetic shield 11. The adjustment does not adversely affect the hermetical sealing of the projection 6*a* maintained by means of the fixing member 47 and the pair of nuts 62 and 63. Thus the degree of vacuum within the cryostat 4 can be maintained. Although the thermally insulating support members 5 are fixed to the liquid helium containers 2, the translation of the containers 2 caused by the adjustment of the relative position is small enough to be safely absorbed by the deflection of the thermally insulating support members 5.

The adjustment of the relative position of the coils along the Z-direction can be performed similarly by means of the thermally insulating support members 5. The adjustment of the relative position of the coils along the Y-direction can be performed by means of the thermally insulating support members 8.

Next, the method of adjusting the relative position of the coils and the cryostat 4 so as to minimize the electromagnetic force acting upon the coils from the magnetic shield 11, as accumulated (i.e., summed up) for all the coils, is described. First the coils are excited by predetermined current levels smaller than the respective rated levels, and the forces acting on the thermally insulating support members 5, 6 and 8 are measured. The coils are translated to a position at which the forces are expected to be below the designed levels. The forces acting on the respective thermally insulating support members 5, 6 and 8 are measured by means of the strain gauges attached thereto. The translation of the coils is performed after the excitation current levels are reduced. By repeating the procedure of the measurement of the forces and the adjustment of the coils as described above, the relative position of the coils is selected where the forces acting upon the thermally insulating support members 5, 6, 8 upon excitation of the coils at rated current levels are held below the design levels. The coils can thus be safely excited.

In the case of the superconducting deflection electromagnet apparatus of FIGS. 13 and. 14, the relative position of the magnetic shield 11 and the cryostat 4 is fixed, and the coils are moved relative to the cryostat 4. As an alternative method of adjusting the relative position of the coils, the cryostat may be moved relative to the magnetic shield 11. Advantages similar to those of the superconducting deflection electromagnet apparatus of FIGS. 13 and 14 may also be obtained by such arrangement.

Figure 15:
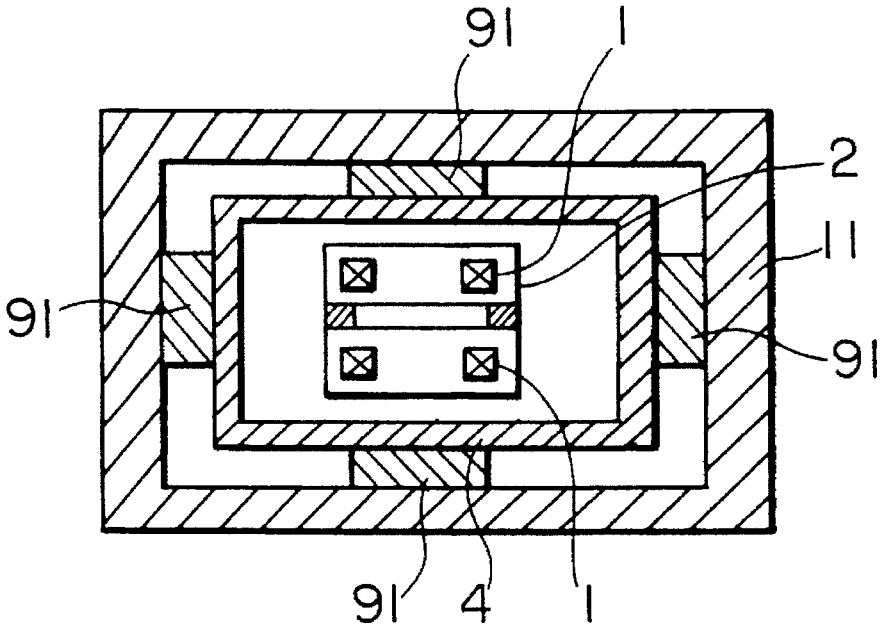
FIG. 15 is a diagrammatic vertical sectional view showing adjustment spacers 91 inserted between the cryostat 4 and the magnetic shield 11 to adjust the relative position therebetween.
Figure 16:
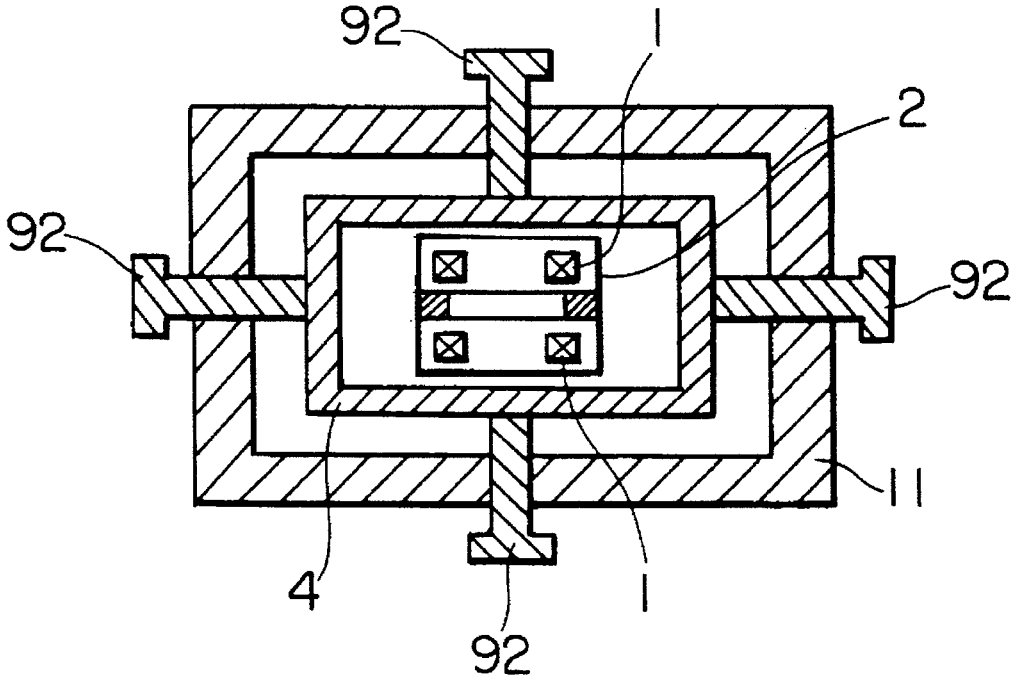
FIG. 16 is a diagrammatic vertical sectional view showing the adjustment bolts 92 screwed into the through-holes formed in the magnetic shield 11 to bear upon the cryostat 4 to adjust the relative position therebetween.

The translation of the cryostat relative to the magnetic shield 11 may be effected by inserting spacers between the cryostat 4 and the magnetic shield 11. FIG. 15 is a diagrammatic vertical sectional view showing adjustment spacers 91 inserted between the cryostat 4 and the magnetic shield 11 to adjust the relative position therebetween. In FIG. 15, the parts not relevant to the understanding of the adjustment spacers 91 are mostly omitted. Alternatively, threaded through-holes may be formed through the walls of the magnetic shield 11, the relative position of the cryostat 4 being adjusted by means of bolts engaging with these through-holes. FIG. 16 is a diagrammatic vertical sectional view showing the adjustment bolts 92 screwed into the through-holes formed in the magnetic shield 11 to bear upon the cryostat 4 to adjust the relative position therebetween. The adjustment bolts 92 are screwed into the threaded through-holes to bear upon and push the walls of the cryostat 4 within the magnetic shield 11.

Figure 17:
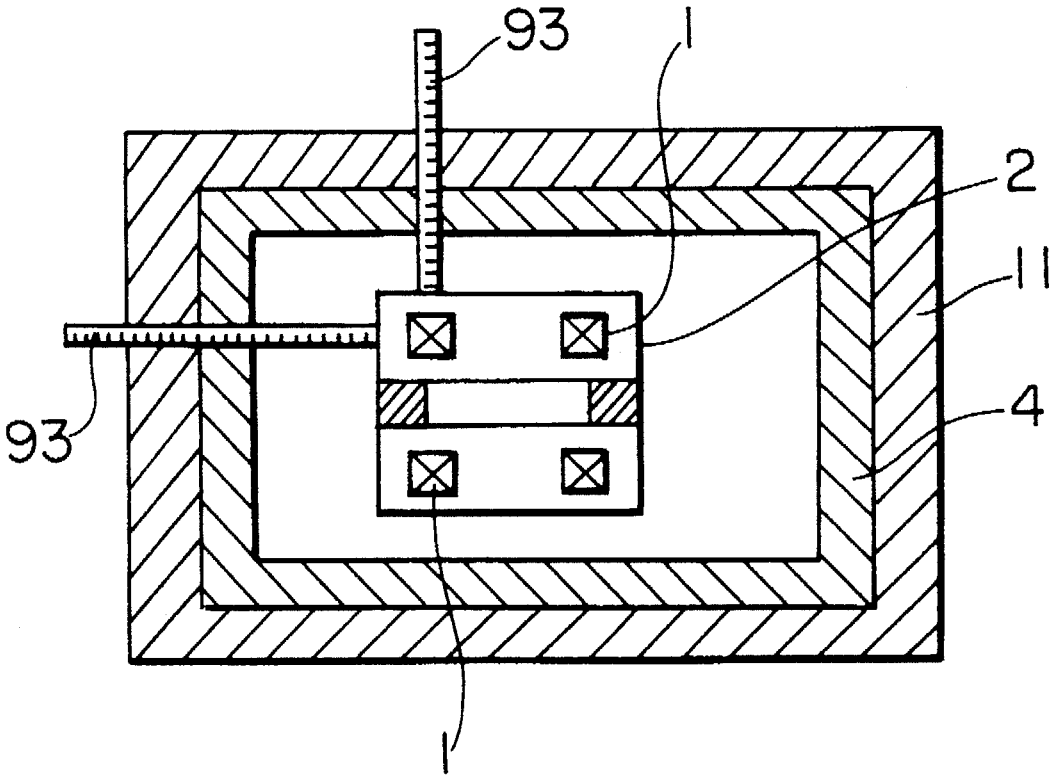
FIG. 17 is a diagrammatic vertical sectional view showing scaled measurement rods 93 inserted hermetically through the cryostat 4 and the magnetic shield 11 to measure the relative position between the coil assemblies and the cryostat 4 or the magnetic shield 11.

It is further noted that the electromagnetic force acting between the coils and the magnetic shield may be inferred by theoretical calculation from the measurements of the relative position of the coils with respect to the cryostat or the magnetic shield. Such calculation allows the adjustment of the relative position of the coils without resorting to the trial and error method described above. The measurements of the relative position of the coils with respect to the cryostat or the magnetic shield may be effected as follows. FIG. 17 is a diagrammatic vertical sectional view showing scaled measurement rods 93 inserted hermetically through the cryostat 4 and the magnetic shield 11 to measure the relative position between the coil assemblies and the cryostat 4 or the magnetic shield 11. A plurality of scaled measurement rods 93 are inserted through hermetically sealed through-holes formed through the walls of the cryostat 4 and the magnetic shield 11. The distances between the predetermined positions of the coils and those of the cryostat or the magnetic shield are measured by means of these measurement rods 93. Since the coils are at a very low temperature, the measurement rods 93 contract as they are cooled within the cryostat 4. It is thus preferred that the coefficient of thermal contraction of the measurement rods 93 is as small as possible. However, the measurements may be performed quickly before the fall in the temperature of the measurement rods 93 is still moderate, such that the effects of the thermal contraction of the measurement rods 93 is minimized.

The above embodiments all relate to superconducting deflection electromagnet apparatus. This invention, however, may be applied to superconducting electromagnet apparatus in general.

What is claimed is:

1. A superconducting electromagnet apparatus for deflecting charged particles, comprising:

means defining passage for the charged particles having an arcuate path in a plane;

a superconducting coil assembly arranged about the passage, the superconducting coil assembly being configured to generate a magnetic field when electrically excited, a portion of the magnetic field passing through the superconducting coil assembly and intersecting the passage in a direction transverse to the plane of the passage;

a cryostat accommodating said superconducting coil assembly;

a magnetic shield surrounding said cryostat and superconducting coil assembly, a portion of the magnetic shield extending transverse to the portion of the magnetic field passing through the superconducting coil assembly, the magnetic shield having at least one port therein to provide communication with the passage for the charged particles; and a coolant medium reservoir disposed outside of said magnetic shield and constructed to provide a coolant medium to said cryostat.

2. A superconducting electromagnetic apparatus comprising:

a superconducting coil assembly having a plane of symmetry;

a cryostat accommodating said superconducting coil assembly; and a magnetic shield having a particular configuration surrounding said cryostat, said magnetic shield including a top plate, a bottom plate, and a side wall, wherein said top plate and bottom plate are provided with through holes and are symmetrical with respect to said plane of symmetry of said superconducting coil assembly in terms of the outer configuration and said through holes.

3. A superconducting electromagnet apparatus comprising:

a superconducting coil assembly;

a cryostat accommodating said superconducting coil assembly; and a magnetic shield surrounding said cryostat, said magnetic shield including a top plate, a bottom plate, and a side wall, wherein said top plate, bottom plate and side wall are constituted as separate members, and at least a portion of said side wall is disposed directly between said top plate and bottom plate.

4. A superconducting electromagnet apparatus comprising:

a superconducting coil assembly;

a cryostat accommodating said superconducting coil assembly; and a magnetic shield surrounding said cryostat, said magnetic shield including a top plate, a bottom plate and a side wall, wherein said top plate, bottom plate and side wall have laminated structures made of layers of thick plates of a predetermined thickness.

5. A superconducting electromagnet apparatus as claimed in claim 2, further comprising a coolant medium reservoir disposed outside of said magnetic shield and communicating with an interior portion of said cryostat through said through-hole of said top plate.

6. A superconducting electromagnet apparatus as claimed in claim 2, wherein said cryostat has a projection extending into said through-hole.

7. A superconducting electromagnet apparatus as claimed in claim 5, wherein said cryostat has a projection extending into said through-hole of said bottom plate.

* * * * *